United States Patent [19]

Oehman, Jr. et al.

[11] Patent Number: 4,768,779

[45] Date of Patent: Sep. 6, 1988

[54] BACK EXERCISE APPARATUS WITH A NECK EXERCISE ATTACHMENT

[75] Inventors: Robert E. Oehman, Jr., Cary; Julia K. Nelson, Durham, both of N.C.

[73] Assignee: Isotechnologies, Inc., Hillsborough, N.C.

[21] Appl. No.: 127,200

[22] Filed: Dec. 1, 1987

[51] Int. Cl.[4] ..... A63B 23/00

[52] U.S. Cl. ..... 272/94; 272/129; 272/130; 272/134

[58] Field of Search ..... 272/93, 94, 96, 117, 272/118, 129, 130, 131, 132, 134, 136, 142; 128/25 R

[56] References Cited

U.S. PATENT DOCUMENTS

| | | | |
|---|---|---|---|
| 3,495,824 | 2/1970 | Cuinier | 272/134 X |
| 4,066,259 | 1/1978 | Brentham | 272/94 |
| 4,278,249 | 7/1981 | Forrest | 272/94 |
| 4,452,447 | 6/1984 | Lepley et al. | 272/130 X |
| 4,462,252 | 7/1984 | Smidt et al. | 272/134 X |
| 4,650,183 | 3/1987 | McIntyre | 272/130 X |
| 4,702,108 | 10/1987 | Amundsen et al. | 272/134 X |
| 4,711,448 | 12/1987 | Minkow et al. | 272/118 |
| 4,727,860 | 1/1988 | McIntyre | 272/130 X |
| 4,733,859 | 3/1988 | Kock et al. | 272/130 X |

OTHER PUBLICATIONS

Advertisement for "The Super Neck Developer" in Coach & Athlete, 1979.

Advertisement for "The Total Neck Developer" in Athletic Journal, 5-1979, p. 43.

The "4-Way Neck Machine" in the Nautilus Instruction Manual, 6-1979.

Advertisement for "The Roughneck" in Coach & Athlete, 11-1981, p. 27.

*Primary Examiner*—Richard J. Apley
*Assistant Examiner*—Robert W. Bahr
*Attorney, Agent, or Firm*—Richard E. Jenkins

[57] ABSTRACT

A back exercise machine having a neck exercise attachment which allows movement about three machine axes corresponding to the cervical axes of flexion/extension, lateral flexion and rotation. Selective resistance to movement about each axes may be provided and torque, position and velocity measurements made with respect to neck movement performance against the resistance.

13 Claims, 3 Drawing Sheets

BACK EXERCISE APPARATUS WITH A NECK EXERCISE ATTACHMENT

TECHNICAL FIELD

This invention relates to an exercise apparatus for the neck, and more particularly to a neck exercise attachment to a low back exercise apparatus of the type operable by human user movements against predetermined resistance. The attachment of the invention has been specifically designed to be fitted to a multi-axial low back exercise machine in order to adapt the machine to measure the functional characteristics of the cervical portion of the spinal column (more commonly called the "neck") and to provide accurate measurements of the torque and concomitant angular position and velocity during movement about the neck axes of flexion/extension, lateral flexion, and axial rotation.

BACKGROUND ART

The use of an exercise apparatus in order to exercise for physical therapy purposes or to exercise for diagnostic and rehabilitation purposes is known. Moreover, it has recently become known to electrically connect a suitably programmed personal computer thereto in order to better determine the functional characteristics of certain natural human joints or articulations such as the lower back, knee or ankle. A representative patent is U.S. Pat. No. 4,650,183 which issued to the assignee of the present invention and is directed to an exercise apparatus for measuring performance of the ankle joint and subtalar joint in the ankle and foot of a user. Also, U.S. Patent Application Ser. No. 871,514 which is owned by the assignee of the present invention is directed to a knee exercise apparatus for measuring the functional characteristics of the knee joint. Of additional interest, the assignee of the present invention has now fully perfected and sells a multi-axial low back exercise apparatus under the trademark ISOSTATION B-200 which measures tri-axial movement of the lower back.

Applicant has now developed an unexpectedly successful conversion to the ISOSTATION B-200 machine which allows for the low back exercise apparatus to be used as a neck exercise apparatus. The attachment conceived by applicant when used in combination with the ISOSTATION B-200 machine provides a neck exercise apparatus which allows for the determination of angular position, velocity and torque associated with neck movement, either alone or simultaneously, about the neck axes of flexion/extension, lateral flexion and axial rotation of the neck. Thus, the ISOSTATION B-200 low back exercise apparatus may be used in its original configuration for exercise of the lower portion of the spine or, in combination with the novel attachment, the ISOSTATION B-200 may be utilized to measure neck exercise movement. The attachment consequently allows for use of the low back exercise apparatus as a multi-purpose machine for both the low back and neck without necessitating the use of a stand-alone neck exercise apparatus.

DISCLOSURE OF THE INVENTION

In accordance with the present invention, applicant provides a novel attachment for use in combination with the ISOSTATION B-200 low back exercise apparatus which adapts the apparatus to measure the functional characteristics of the cervical spine or neck. Accurate measurement may be made of the torque generated in each of the three primary axes of movement of the neck, flexion/extension, lateral flexion and rotation, during either dynamic or isometric testing, as well as velocity and positional information during dynamic testing of the neck by positively aligning the natural axes of the neck so as to be substantially coaxial with the pivotable axes of machine movement provided for by the neck exercise attachment to the conventional low back exercise machine.

The instant invention is of a novel construction which accommodates tri-axial and simultaneous movement of the neck about the natural neck axes of flexion-/extension, lateral flexion and rotation. A predetermined and independent resistance to movement can be selected for each of the three axes of neck movement. Alternatively, any or all of the aforementioned three axes of neck movement may be locked in order for the attachment to the low back exercise apparatus to accommodate static or isometric testing of movement about a selected axis or axes of neck movement in multiple positions.

Therefore, it is a primary object of the present invention to provide an attachment for a conventional low back exercise apparatus which allows for the accurate and precise measurement of the functional characteristics of neck movement performance. In realizing this objective, an apparatus is provided having the ability to measure, either simultaneously or selectively, neck movement about all three natural axes of neck pivotable movement.

Another object of the present invention is to provide an attachment to a low back exercise apparatus which allows for monitoring the torques and concomitant angular positions and velocity changes associated with neck movement about the axes of flexion/extension, lateral flexion and axial rotation.

A further object of the present invention is to provide an attachment to a low back exercise machine which allows for either isometric or static testing of neck movement about one or more of the axes of flexion/extension, lateral flexion and rotation movement of the neck.

A still further object of the present invention is to provide an attachment for a low back exercise apparatus which provides for simultaneous pivotable movement about three machine axes which correspond to and are coaxial with the natural axes of flexion/extension, lateral flexion and rotation movement and which allows for independent resistance to motion to be selected for each of the three machine axes.

BRIEF DESCRIPTION OF THE DRAWINGS

Some of the objects of the invention having been stated, other objects will appear as the description proceeds, when taken in connection with the accompanying drawings, in which.

BEST MODE FOR CARRYING OUT THE INVENTION

While the present invention will be described hereinafter with particular reference to the accompanying drawings, in which a certain operating embodiment of the apparatus of the present invention is shown, it is to be understood at the outset of the description which follows that it is contemplated that apparatus in accordance with the present invention may be varied from the specific form described hereinafter, while still attaining the desired result of this invention. Accordingly, the description which follows is to be understood as a broad teaching disclosure directed to persons of appropriate skill in the appropriate arts, and not as limiting upon the scope of this invention.

Figure 1:
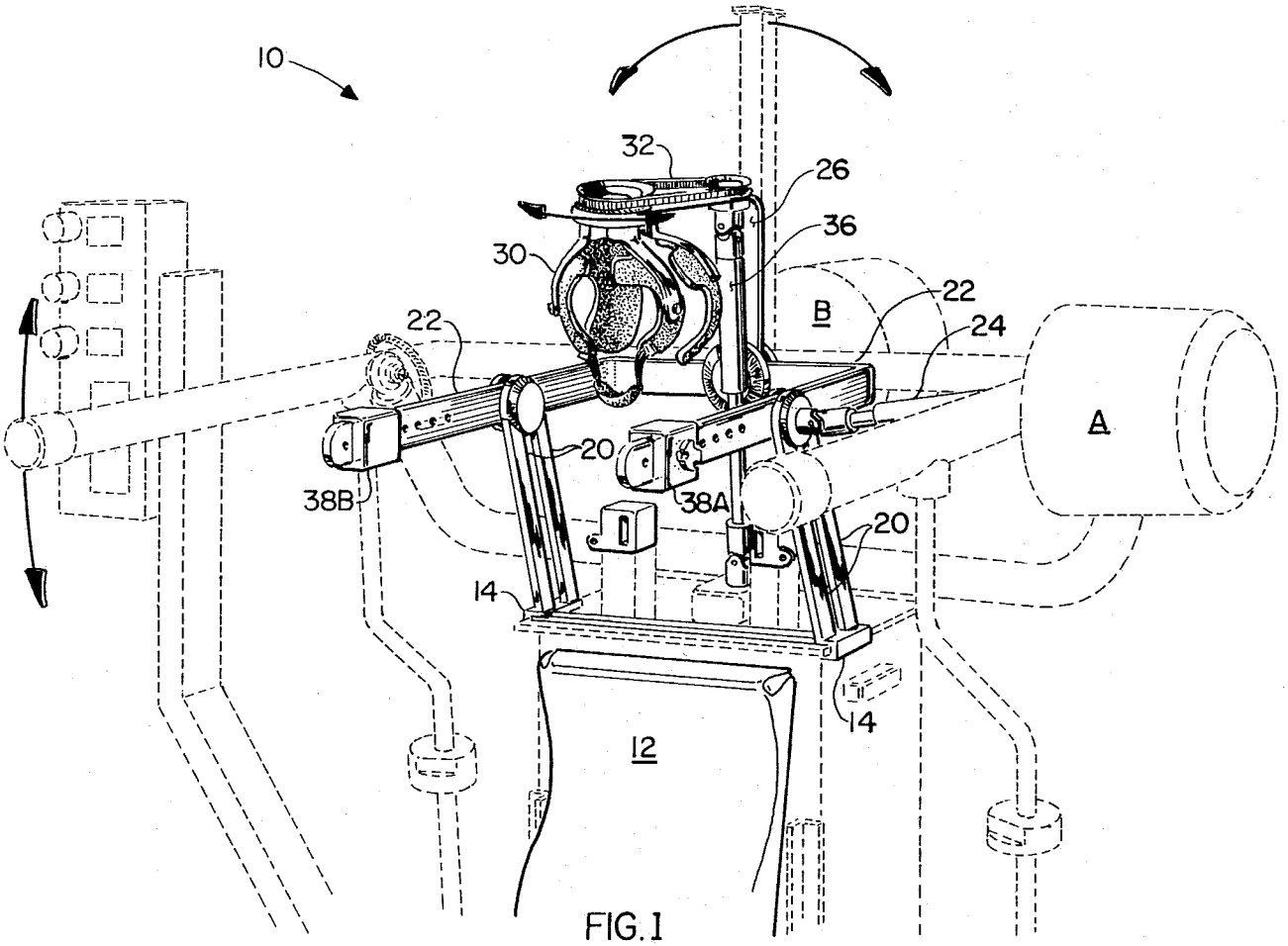
FIG. 1 is an enlarged fragmentary prospective view of the neck exercise attachment secured to a conventional low back exercise apparatus shown in phantom lines.
Figure 2:
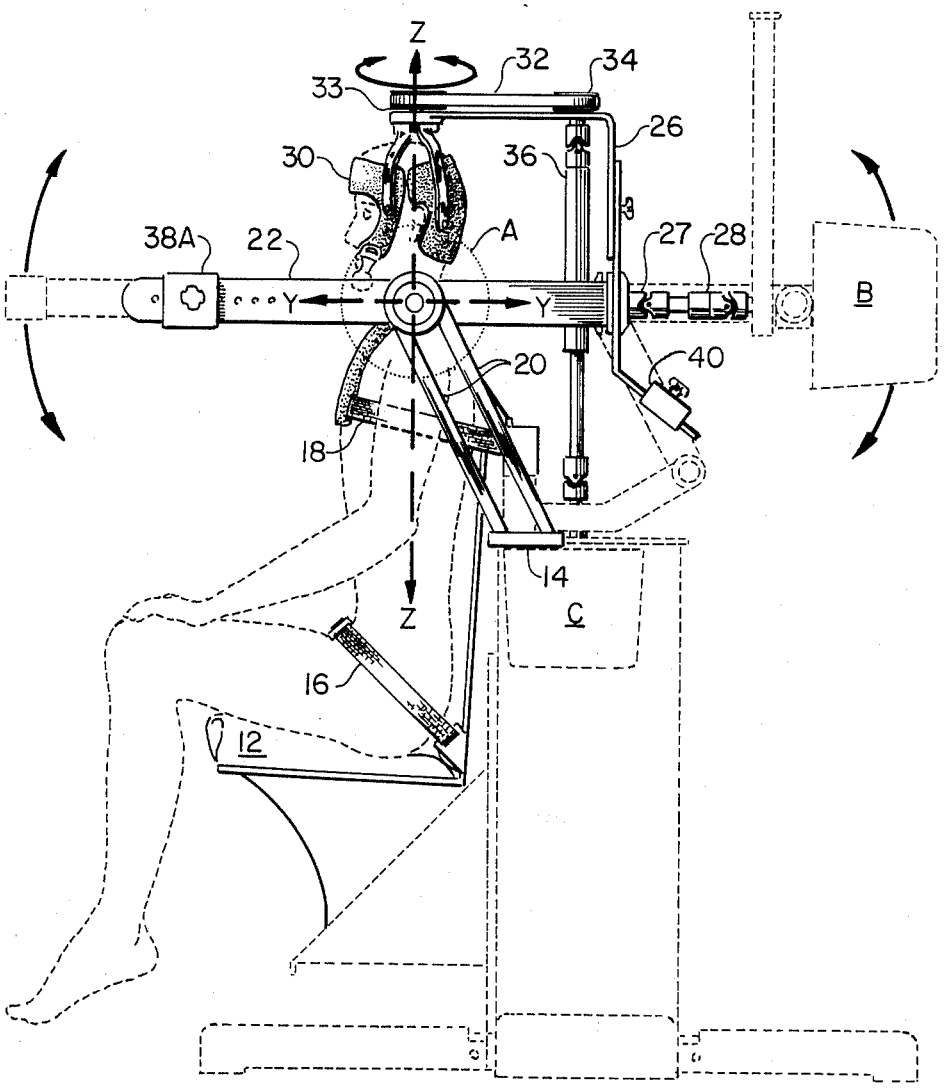
FIG. 2 is a vertical cross section view taken on lines 2—2 of FIG. 3 and showing the user in phantom lines.
Figure 3:
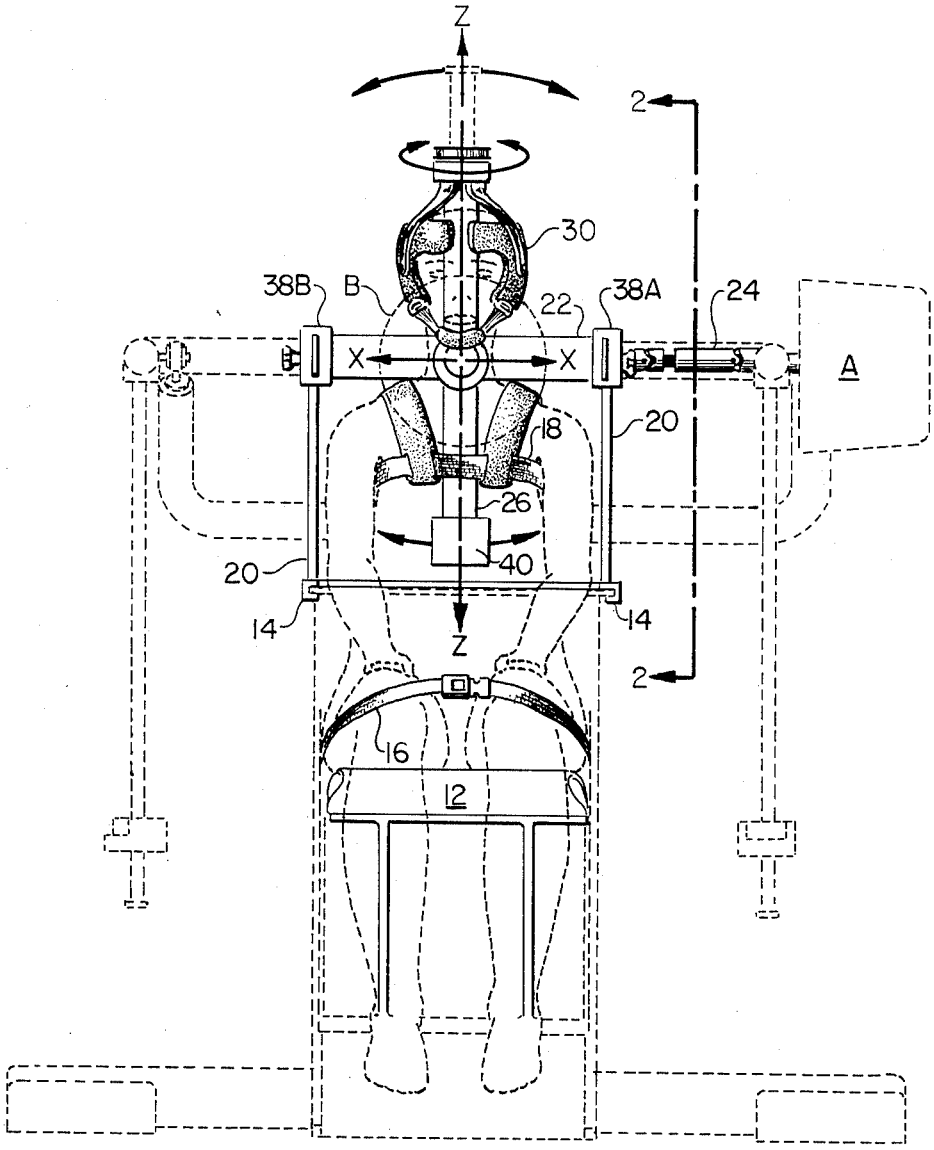
FIG. 3 is a front elevation view of the neck exercise attachment secured to a conventional low back exercise apparatus wherein the user and the conventional exercise apparatus are shown in phantom lines.

Referring now to FIGS. 1, 2 and 3, a neck exercise attachment for the ISOSTATION B-200 lower back exercise machine (manufactured by Isotechnologies, Inc. of Hillsborough, N.C.) is there illustrated and generally designated 10. As will be observed, the gimbal structure of neck exercise attachment 10 is substantially located within and attached to the conventional gimbal structure of the ISOSTATION B-200 lower back exercise machine. In this fashion the conventional machine can be easily converted for use in measuring the performance of the neck.

As will be understood by those familiar with the art, in order to secure the neck exercise attachment of the invention to the ISOSTATION B-200 machine the original seat portion thereof is first removed. The neck exercise attachment 10 is then secured to the top of the cabinet of the lower back exercise machine. In the preferred embodiment of the invention, attachment 10 may be adjusted forwardly or rearwardly of the cabinet and then secured in order to properly align attachment 10 with a user's neck. A seat 12 is provided for the user and secured by conventional means to the vertically adjustable feet elevator of the ISOSTATION B-200 machine.

Neck exercise attachment 10 comprises frame 14 which, as noted above, is slidably secured to the cabinet of the low back exercise machine. A pelvic restraint 16 is secured to seat 12 by conventional means and a thoracic restraint, which may be of any suitable restraint design, is secured to the cabinet of the low back exercise machine by suitable and conventional means but would alternatively be secured to seat 12. Although not shown, the aforementioned cabinet houses the hydraulic and electrical circuitry of the low back exercise machine as well as the vertical adjustment mechanism for the feet elevator which now has seat 12 secured thereto.

With particular reference to FIGS. 1 and 2, frame 14 can be seen to include two generally upwardly extending posts 20 positioned on each side of seat 12. Posts 20 are secured to frame 12 of neck exercise attachment 10. A U-shaped gimbal 22 is pivotably mounted at the medial or middle portion of each arm to a respective pair of the two upstanding posts 20. Gimbal 22 is pivotably mounted to posts 20 so that the arms thereof extend generally alongside and outwardly from a user (shown in phantom lines in FIGS. 2 and 3) positioned on seat 12. Gimbal 22 is operatively connected to hydraulic actuator A of the low back exercise machine by an axially free universal joint assembly 24 (see FIG. 3). Hydraulic actuator A is utilized to provide selective resistance to user neck movement about the axis of flexion/extension of the neck which is coaxial with machine axis X of pivotable movement of U-shaped gimbal 22 on posts 20. An inverted "L" shaped support member 26 is pivotably mounted at the lower end to the medial portion of the back of U-shaped gimbal 22 so as to extend generally vertically upward therefrom and forwardly over the head of a user positioned in seat 12. L-shaped support member 26 is pivotably mounted to U-shaped gimbal 22 with a shaft assembly 27 which is coaxially aligned with the lateral flexion axis of the neck and which is operatively connected to hydraulic actuator B of the low back exercise machine by a second axially free universal joint assembly 28 (see FIG. 2). The connection of support member 26 and universal assembly joint 28 to hydraulic actuator B provides selective resistance to user movement about machine axis Y (see FIG. 2) which is coaxial with the axis of lateral flexion of the neck. Hydraulic actuator B therefore serves to provide a predetermined and selective resistance to movement of a user's neck about the axis of lateral flexion which is independent of the predetermined resistance provided by hydraulic actuator A to movement about the neck axis of flexion/extension.

A helmet 30, which is adjustable for varying head sizes, is rotatably attached to support member 26 immediately above the head of a user so that the machine axis of rotation Z will be coaxial with the rotational axis of the cervical spine or neck. A third hydraulic actuator C of the low back exercise machine is operatively associated with helmet 30 in order to provide a predetermined and selective resistance to movement of a user's neck about the Z axis of rotation which is independent of the predetermined resistance provided by hydraulic actuator B to movement about the Y axis and hydraulic actuator A to movement about the X axis. Helmet 30 is operatively connected to hydraulic actuator C by a belt 32 which is attached at one end to a pulley 33 and shaft secured to helmet 30 and at the other end to a pulley 34 and shaft secured to support member 26. A third axially floating universal joint assembly 36 is connected at one end to the shaft of pulley 34 and at the other end to hydraulic actuator C, third joint assembly 36 (as well as first joint assembly 24 and second joint assembly 28) are adjustable in length to facilitate alignment of the machine and neck axes and to accommodate different head and neck lengths.

Applicant wishes to note that the conventional ISOSTATION B-200 low back exercise apparatus normally provides torque and position transducers and velocity measuring means in cooperative association with each axis of movement, (in addition to the aforementioned hydraulic actuators A, B, C) in order to provide desired performance measurements of torque, angular movement and angular velocity about each of the three back movement axes and the attachment utilizes the same equipment to analyze neck movement. Although a matter of design choice in the ISOSTATION B-200 machine, strain gauges, pneumatic transducers or analog gauges may be utilized to provided the required measurement of torque about each of the three natural axes of neck movement which correspond to the three axes of machine movement. Potentiometers may be utilized as position transducers to measure angular movement, and velocity of movement about each of the three axes may be measured utilizing conventional electronic and/or numerical computation means as a matter of design choice. The cabinet of the low back exercise apparatus may contain the control means for independently selecting the resistance to movement about the neck axes of flexion/extension, lateral flexion and rotation of the cervical spine and/or an electrically connected and appropriately programmed personal computer as described hereinafter may be utilized to do so.

The position of a user is controlled by proper vertical adjustment of seat 12 and front-to-back adjustment of frame 14 relative to the cabinet of the ISOSTATION B-200 machine for coaxial alignment of the machine axes (X, Y and Z) with the natural cervical axes. Also, support member 26 is adjustable in vertical length to accommodate differing length necks of various users being tested. The objective of adjusting seat 12, frame 14 and support member 26 is to assure that machine axes X, Y and Z are in substantially correct coalignment with the natural cervical axes of flexion/extension, lateral flexion and rotation.

Neck exercise attachment 10 also includes counterweights 38A and 38B on U-shaped gimbal 22 and counterweight 40 on the lower end of support member 26 which may be slidably adjusted by conventional means in order to assure that the entire neck exercise attachment is gravity independent when secured to a user so that measurements of neck movement about axes X, Y and Z will accurately reflect neck performance and not be influenced by the weight of the apparatus utilized to measure movement about the axes. Finally, applicant wishes to note that the present invention contemplates that U-shaped gimbal 22, support member 26 and helmet 30 may be pivotably locked by suitable conventional means in order for isometric or static performance testing of the neck at substantially any orientation. Although there would not be an angular position or velocity to measure for any locked axis of neck movement, the torque exerted against that particular axis could be measured in order to provide desired isometric testing data.

In operation, neck exercise attachment apparatus 10 is first secured to an ISOSTATION B-200 machine by removing the original seat and securing seat 12 thereto as described hereinbefore. A user is then seated on seat 12 and secured thereto with pelvic restraint 16 and thoracic restraint 18. Helmet 30 is fastened to the head of the user after any necessary adjustment is made to seat 12, frame 14 and/or support member 26 to assure that the user's neck axes of flexion/extension, lateral flexion and pivotable rotation correspond with the X, Y and Z axes of movement of apparatus 10 and are substantially coaxial therewith. With the user now properly aligned in apparatus 10, selective resistance is established to movement about the X, Y and Z axes through selective settings of hydraulic actuators A, B and C, respectively. Counterweights 38A, 38B and 40 are then adjusted to assure that the entire apparatus is gravity independent so that neck movement measurement data will be accurate.

Although not shown in the drawings, a suitably programmed and electrically connected personal computer is normally associated with the ISOSTATION B-200 low back exercise machine in order to establish selective resistance to movement about the X, Y and Z axes and to analyze and record the pounds-feet of torque effort and the concomitant angular position and velocity changes during movement of the neck of a user about the X axis of flexion/extension, the Y axis of lateral flexion, and the Z axis of rotation in order to better determine and record functional characteristics of the neck. The computerized evaluation of the neck movement may be utilized to determine the extent of deficiency of performance of the neck due to athletic injury or other causes such as aging or disease. It should also be appreciated that the computer program could be suitably utilized to provide graphs, reports and protocols in addition to storage/retrieval and comparisons.

In conclusion, the subject invention provides for a novel neck exercise attachment for a conventional low back exercise machine which is capable of heretofore unavailable movement performance evaluation of multi-axial neck movement.

What is claimed is:

1. In combination with an exercise machine of the type adapted for multi-axial movement of the lower back against a selective resistance provided by first, second and third resistance means associated, respectively, with flexion/extension, lateral flexion and rotational movement of the lower back, said machine providing for accurate measurement of the torque and concomitant angular position and velocity associated with movement against said resistance means associated each of said axes of movement, an attachment to adapt said machine for measurement of neck exercise movements comprising:

an attachment frame secured to said low back exercise machine;

a neck exercise assembly pivotably mounted to said frame and including a pivotably movable support member and means extending generally upwardly therefrom for securing the head of a user, said support member being pivotably movable relative to said frame about a horizontal axis which corresponds to an axis of rotation which is coaxial with the axis of flexion/extension movement of the neck, and said means for securing the head being pivotably movable relative to said support member about an axis of rotation which is generally perpendicular to said horizontal axis and coaxial with the axis of lateral flexion movement of the neck;

a head engagement device pivotably mounted to said means for securing the head, said head engagement device being pivotably movable relative to said head securement means about a vertical axis which is generally perpendicular to said horizontal axis and coaxial with the axis of rotation movement of the neck;

first flexible connecting means for operatively connecting the first resistance means of said exercise machine to said support member of said neck exercise assembly for resisting flexion/extension movement of the neck of a user;

second flexible connecting means for operatively connecting the second resistance means of said exercise machine to said head securement means of said neck exercise assembly for resisting lateral flexion movement of the neck of a user;

third flexible connecting means for operatively connecting the third resistance means of said exercise machine to said head engagement device for resisting rotational movement of the neck of a user; and restraint means for securing the user during exercise of the neck;

whereby said attachment to said low back exercise machine permits simultaneous multi-axial pivotal movement of the neck about its natural axes.

2. A combination back exercise machine and attachment according to claim 1 wherein said first resistance means comprises a hydraulic rotary actuator.

3. A combination back exercise machine and attachment according to claim 1 wherein said second resistance means comprises a hydraulic rotary actuator.

4. A combination back exercise machine and attachment according to claim 1 wherein said third resistance means comprises a hydraulic rotary actuator.

5. A combination back exercise machine and attachment according to claim 1 wherein said axes of flexion-/extension movement, lateral flexion movement and rotational movement of the neck are all substantially mutually perpendicular.

6. A combination back exercise machine and attachment according to claim 1 wherein said head engagement device comprises an adjustable helmet.

7. A combination back exercise machine and attachment according to claim 1 wherein said first, second and third flexible connecting means each comprises a flexible universal joint assembly.

8. A combination back exercise machine and attachment according to claim 1 wherein said restraint means comprises a seat with thoracic and pelvic restraints for securing a user of said apparatus.

9. A combination back exercise machine and attachment according to claim 8 wherein said seat is adjustable to facilitate proper alignment of a user in relation to said apparatus.

10. A combination back exercise machine and attachment according to claim 1 wherein said frame of said attachment is adjustable relative to said machine to facilitate proper alignment of a user in relation to said apparatus.

11. A combination back exercise machine and attachment according to claim 1 including means to selectively prevent pivotal movement by said support member, head securement means or head engagement device to facilitate isometric exercise of the neck about the corresponding axes of flexion/extension movement, lateral flexion movement or rotational movement of the neck of a user in multiple positions.

12. A combination back exercise machine and attachment according to claim 1 including a electrically associated computer for analyzing performance of the neck of a user during flexion/extension, lateral extension and rotational movement.

13. An apparatus according to claim 12 wherein said computer is adapted to independently and selectively control the resistance to movement about each of said axes of movement.

* * * * *